US005503080A

United States Patent [19]

Goward et al.

[11] Patent Number: 5,503,080

[45] Date of Patent: Apr. 2, 1996

[54] BOMB RETAINING DEVICE

[75] Inventors: Stephen G. Goward, Beeston; Peter P. Pietralski, West Bridgford, both of England

[73] Assignee: Royal Ordnance plc, Chorley, England

[21] Appl. No.: 328,436

[22] Filed: Oct. 25, 1994

[30] Foreign Application Priority Data

Oct. 29, 1993 [GB] United Kingdom ..... 9322392

[51] Int. Cl.[6] ..... F42B 30/08

[52] U.S. Cl. ..... 102/293; 102/372; 102/374; 102/439; 102/520

[58] Field of Search ..... 102/293, 372, 102/373, 374, 376, 439, 466, 467, 520–523, 532; 244/3.3; 89/1.3, 1.35, 14.05, 1.806, 1.704, 1.706

[56] References Cited

U.S. PATENT DOCUMENTS

| | | | |
|---|---|---|---|
| 2,368,064 | 1/1945 | Fanger | 89/1.35 |
| 3,656,435 | 4/1972 | Barr et al. | 102/368 |
| 3,978,792 | 9/1976 | Campoli et al. | 102/521 |

FOREIGN PATENT DOCUMENTS

| | | | |
|---|---|---|---|
| 74385 | 12/1944 | Czechoslovakia | 102/373 |
| 543611 | 9/1922 | France | 89/1.3 |
| 80926 | 7/1934 | Sweden | 102/372 |
| 247017 | 11/1947 | Switzerland | 102/373 |

*Primary Examiner*—Harold J. Tudor
*Attorney, Agent, or Firm*—Nixon & Vanderhye

[57] ABSTRACT

A clip for the retention of a round of ammunition in a desired position in a barrel is described, the clip being manufactured from a plastics material and comprising a generally cylindrical body portion; the body portion having a plurality of generally radially and axially directed grooves therein, said grooves being adapted to engage the tail fins of an associated round of ammunition; engagement means extending at least part of the way around said body portion, said engagement means having a greater diameter than that of the body portion and being adapted to engage with a recess at the breech-end of an associated gun barrel to prevent forward movement; and a substantially central aperture to allow access to the propellant charge of the associated round of ammunition.

16 Claims, 7 Drawing Sheets

BOMB RETAINING DEVICE

BACKGROUND OF THE INVENTION

1. Field of the Invention

The present invention relates to a clip device for locating a bomb or round of ammunition axially in the barrel of a gun or mortar, and preventing the bomb or ammunition from slipping forwards when the muzzle of the barrel is depressed.

DISCUSSION OF PRIOR ART

The content of our co-pending published patent application number WO 93/07439 is incorporated herein by reference. This reference describes inter alia a breech loading mortar system having means for preventing a round of ammunition from slipping backwards after being loaded when the barrel is at a relatively high angle of elevation. However, equally important is the need to positively prevent the round of ammunition from sliding forwards after loading and prior to firing when the muzzle of the barrel is at a relatively low angle of depression. If the round were to slide forwards, the firing pin would be unable to reach and ignite the propellant charge.

SUMMARY OF THE INVENTION

According to the present invention there is provided a clip for the retention of a round of ammunition in a desired position in a barrel, the clip being manufactured from a plastics material and comprising a generally cylindrical body portion; the body portion having a plurality of generally radially and axially directed grooves therein, said grooves being adapted to engage the tail fins of an associated round of ammunition; engagement means extending at least part of the way around said body portion, said engagement means having a greater diameter than that of the body portion and being adapted to engage with a recess at the breech-end of an associated gun barrel to prevent forward movement; and a substantially central aperture to allow access to the propellant charge of the associated round of ammunition.

The round of ammunition may be a bomb for a mortar weapon or a round for an artillery or tank gun, particularly a smooth bore artillery or tank gun.

The round of ammunition is preferably retained both longitudinally and axially in the barrel.

The grooves may be so dimensioned as to engage with and grip the tail fins of the associated round of ammunition by virtue of an interference fit between the walls of the grooves and the tail fins.

The generally cylindrical body portion may be in the form of a disc having an aperture therethrough or an annular ring of relatively short axial length, the ring being divided into a number of segments by the grooves. The grooves may have one or more apertures in their base over a part, but not all, of the groove radial width. The purpose of such apertures may be to control the resilience of the segments relative to each other.

There may be additional grooves provided over and above the number required to engage with the tail fins of the round of ammunition. Such additional grooves may be provided to increase the available resilient deflection of segments adjacent a tail fin and so control the strength of interference fit.

The engagement means may be a flange portion and may be provided substantially at one axial end of the body portion and engage with a recess in the barrel at the breech end. The type of recess may, for example, be as shown in our copending patent application number WO 93/07439, but will in any event be dimensioned so as to cooperate therewith and position and retain the propellant charge of the ammunition round in firing proximity to the firing pin of the weapon.

The engagement means may comprise a flange portion in the form of a continuous circumferential flange, a discontinuous flange around the circumference or a number of projections such as pips around the circumference.

The retaining clip may advantageously be made by moulding from a plastics material such as acetal co-polymer for example.

After firing the clip remains in the barrel from where it may be removed prior to loading the next round. Appropriate finger holes may be moulded into the segments to facilitate removal.

BRIEF DESCRIPTION OF THE DRAWINGS

In order that the present invention may be more fully understood, an example will now be described by way of illustration only with reference to the accompanying drawings, of which.

DETAILED DISCUSSION OF PREFERRED EMBODIMENT

Figure 1:
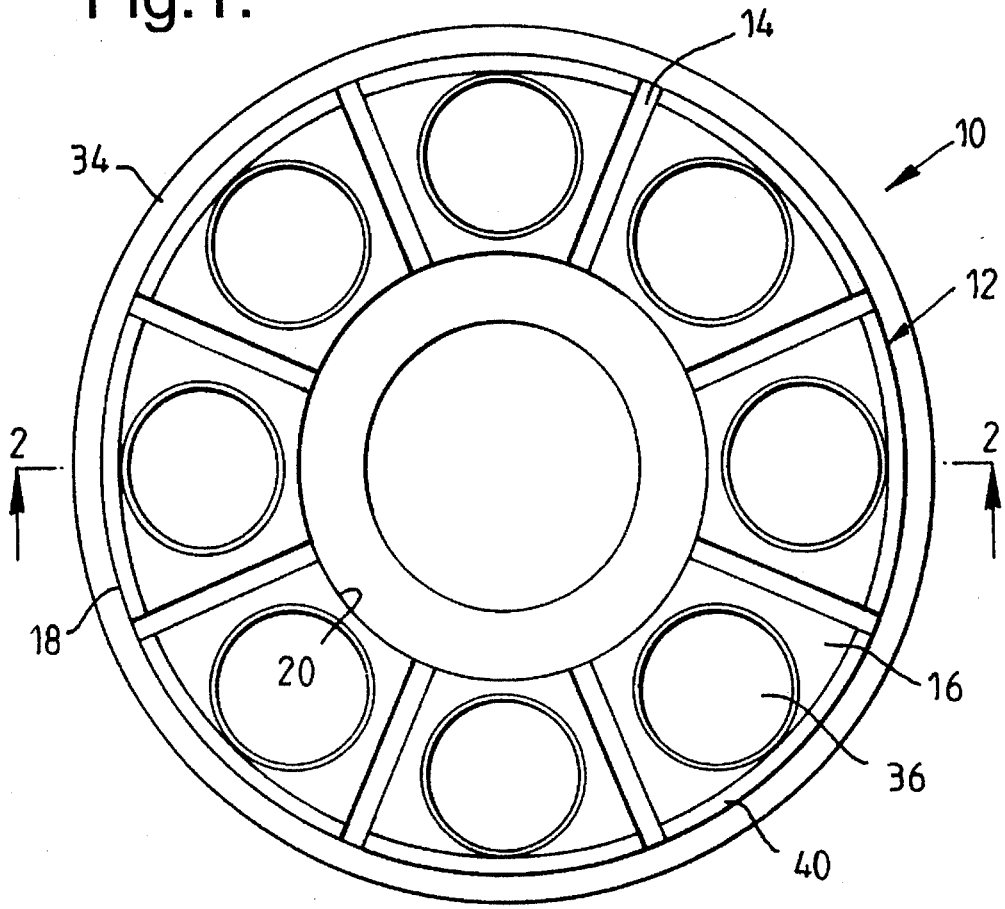
FIG. 1 shows a plan view of a retaining clip for a round of ammunition according to the present invention.

Referring now to the drawings and where the same features are denoted by common reference numerals.

Figure 2:
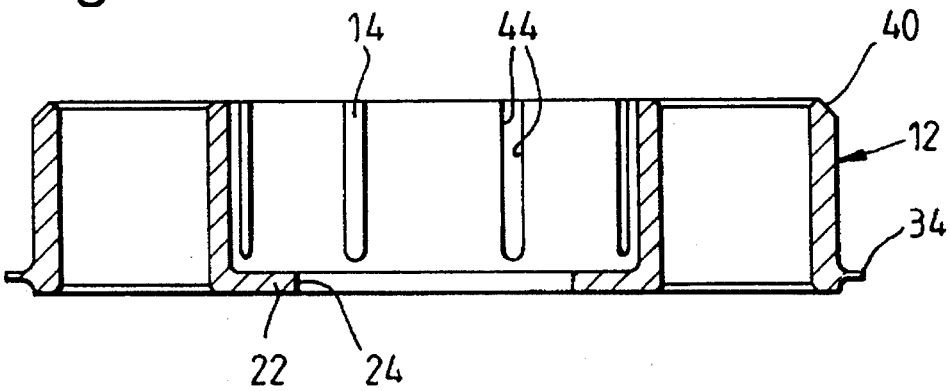
FIG. 2 shows a section along the line 2—2 of FIG. 1.
Figure 3:
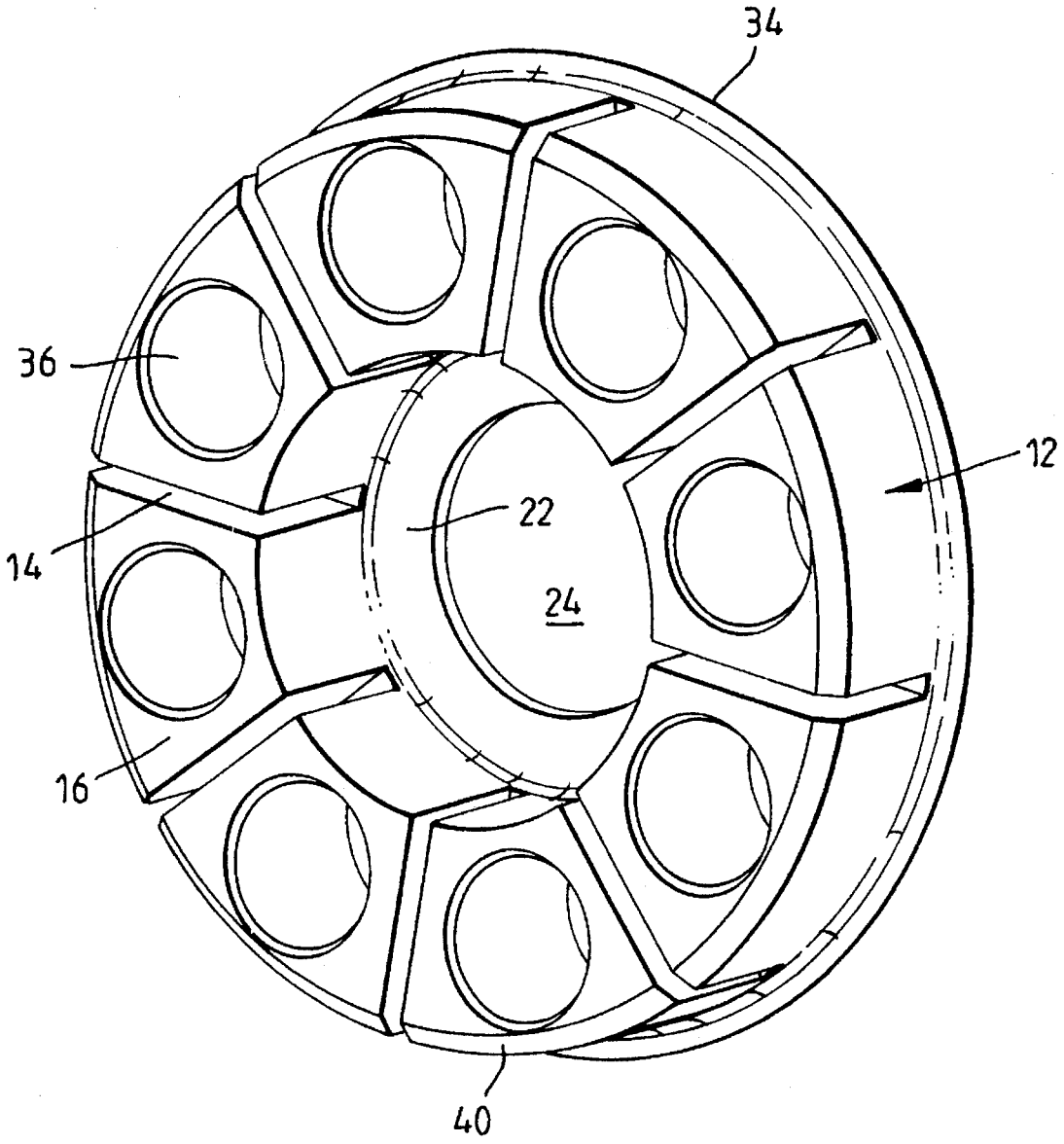
FIG. 3 shows a perspective view of the clip of FIGS. 1 and 2.
Figure 4:
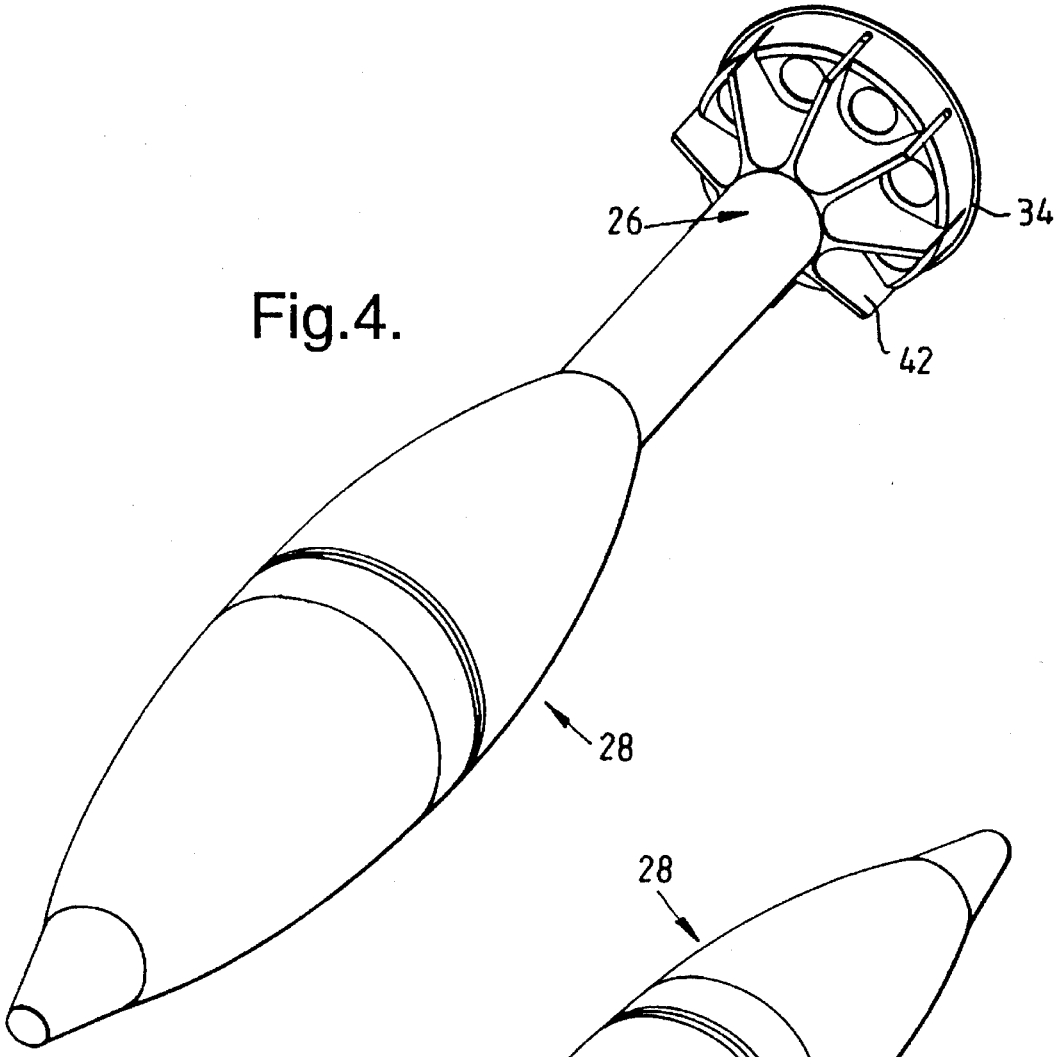
FIG. 4 shows a front perspective view of the clip of FIG. 3 attached to a round of ammunition.
Figure 5:
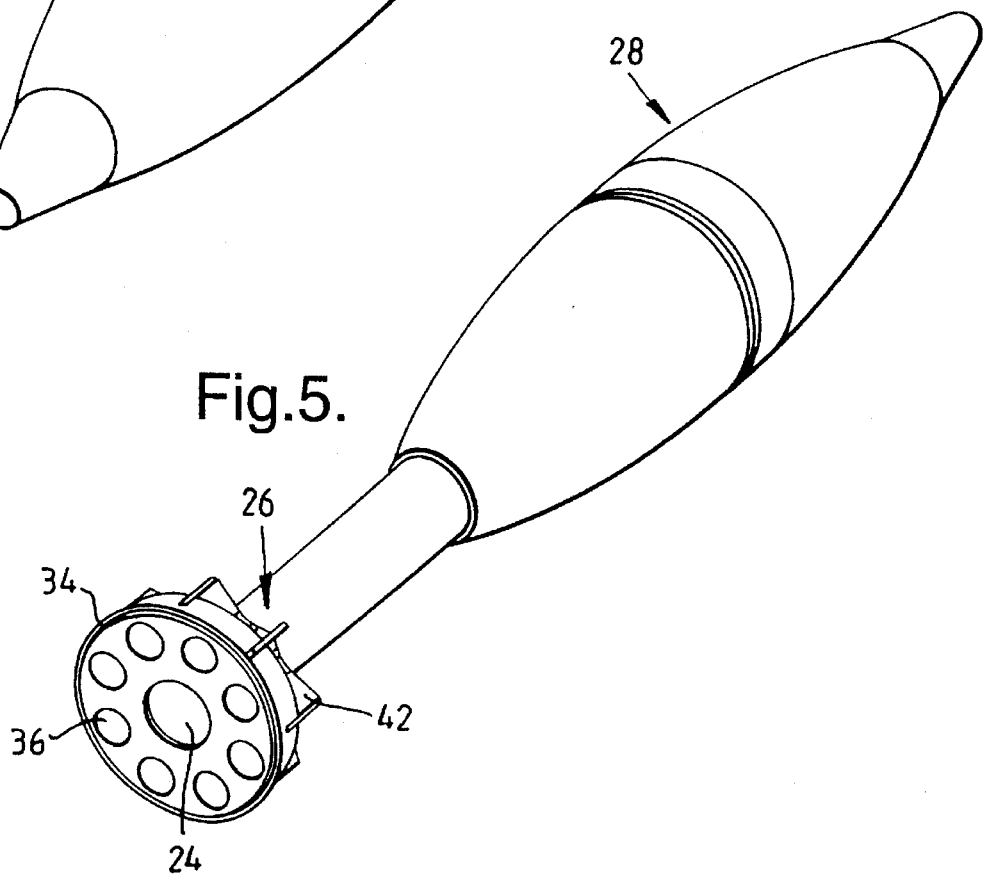
FIG. 5 shows a rear perspective view similar to that of FIG. 4.
Figure 6:
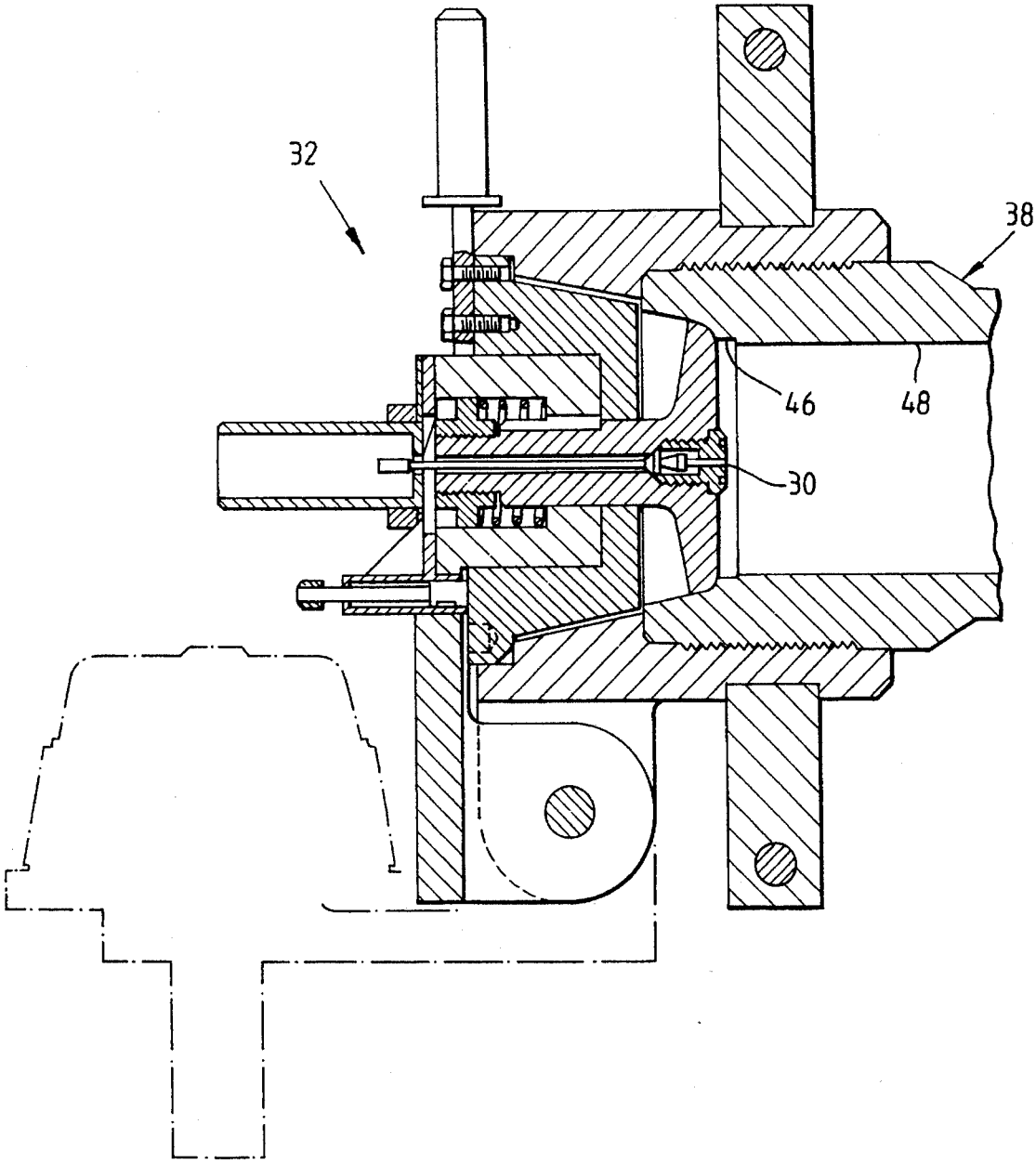
FIG. 6 shows a section through the breech assembly and part of the barrel of a mortar.
Figure 9:
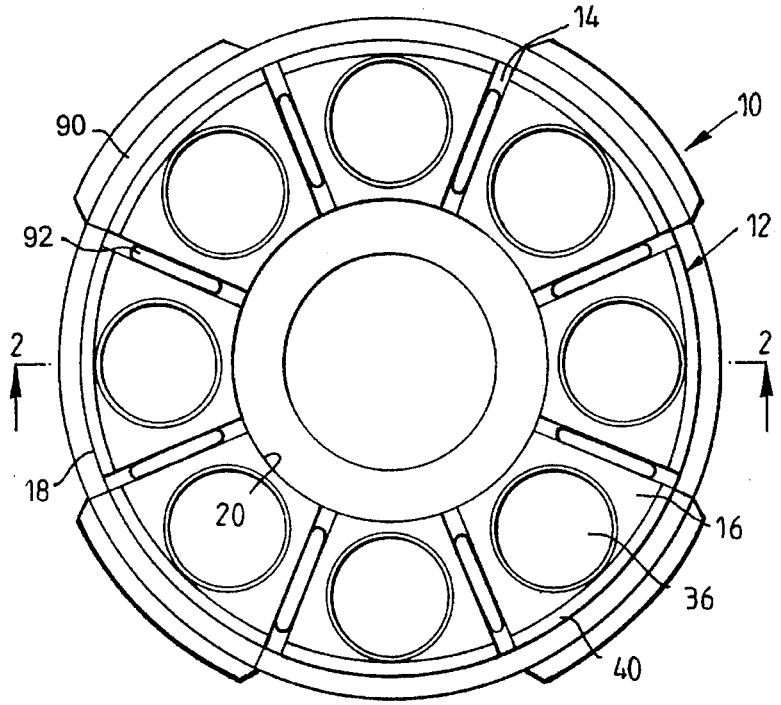
FIG. 9 shows a modification of the clip shown in FIG. 1.
Figure 10:
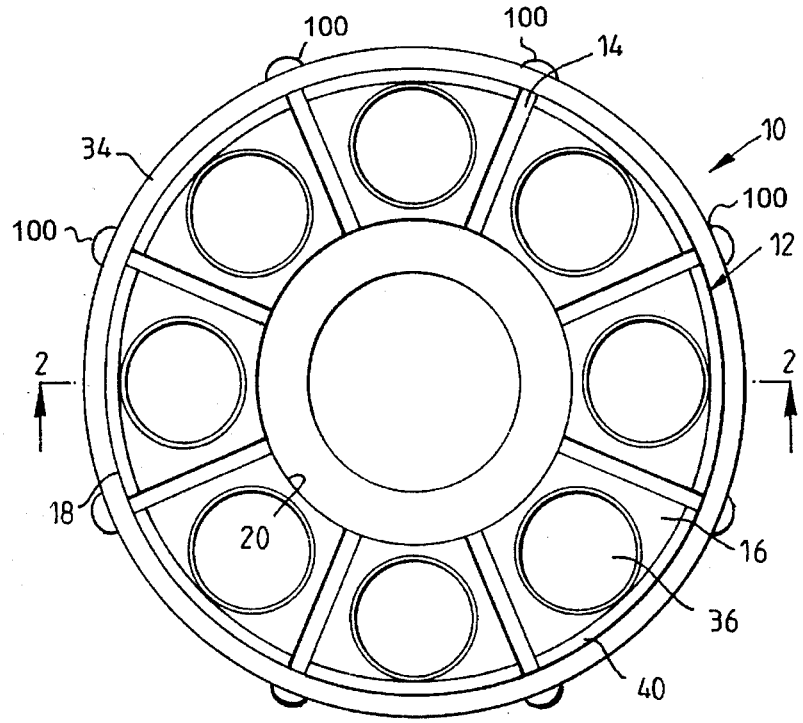
FIG. 10 shows a further modification of the clip of FIG. 1.

Referring first to FIG. 1 to 6 and where a retaining clip for a round of ammunition is designated generally at 10. The clip comprises a generally ring-shaped or cylindrical body portion 12 having radially and axially directed grooves 14 which do not pass through the entire axial thickness of the body portion. The grooves 14 divide the body portion 12 into segments 16 having an outer diameter 18 and an inner diameter 20. The groove 14 may also have an aperture 92 at the base thereof over a portion of the groove width as shown in FIG. 9. In effect, there is a circular flat plate portion 22 having the segments 16 thereon. The plate portion 22 has a central aperture 24 which allows access to the propellant charge 26 of a bomb 28 by a firing pin 30 in the weapon (designated generally at 32 in FIG. 6) from which the bomb 28 is to be fired. The clip has a flange portion 34 substantially at one axial end of the body portion 12 as shown in FIG. 2 or a discontinuous flange 90 as shown in FIG. 9 or projections 100 as shown in FIG. 10. Finger holes 36 are formed in the segments 16 to facilitate both placement of the bomb in the barrel 38 and removal of the clip from the barrel after firing. A chamfer 40 is provided on the outer diameter of the leading edge of the body portion to facilitate loading into the barrel. The tail fins 42 of the bomb 28 engage with the walls 44 of the grooves 14 to form an interference fit therewith. The resilience of the plastics material from which the clip is moulded allows slight relative movement between adjacent segments 16 to enable the fins 42 to fit snugly in the grooves 14. The grooves are so dimensioned as to allow sufficient interference fit with the fins to prevent the bomb from becoming detached from the clip in the forward direction by gravity alone but, not so much as to significantly influence the firing of the bomb on ignition of the propellant charge 26. The flange 34 engages with a recess 46 at the breech-end of the barrel 38, the recess having a greater diameter than the remainder of the barrel bore 48. Engagement of the flange 34 with the recess 46 prevents the bomb from sliding forwards when the barrel is depressed.

Correct longitudinal positioning within the gun barrel will ensure that the firing pin or other firing means successfully reaches and engages the primer cartridge positioned axially at the rear of the bomb. The clip also locates the bomb axially in the mortar tube ensuring that the primer is positioned concentrically in the barrel and is readily engaged by the firing pin which operates along the axis of the barrel.

Figure 7:
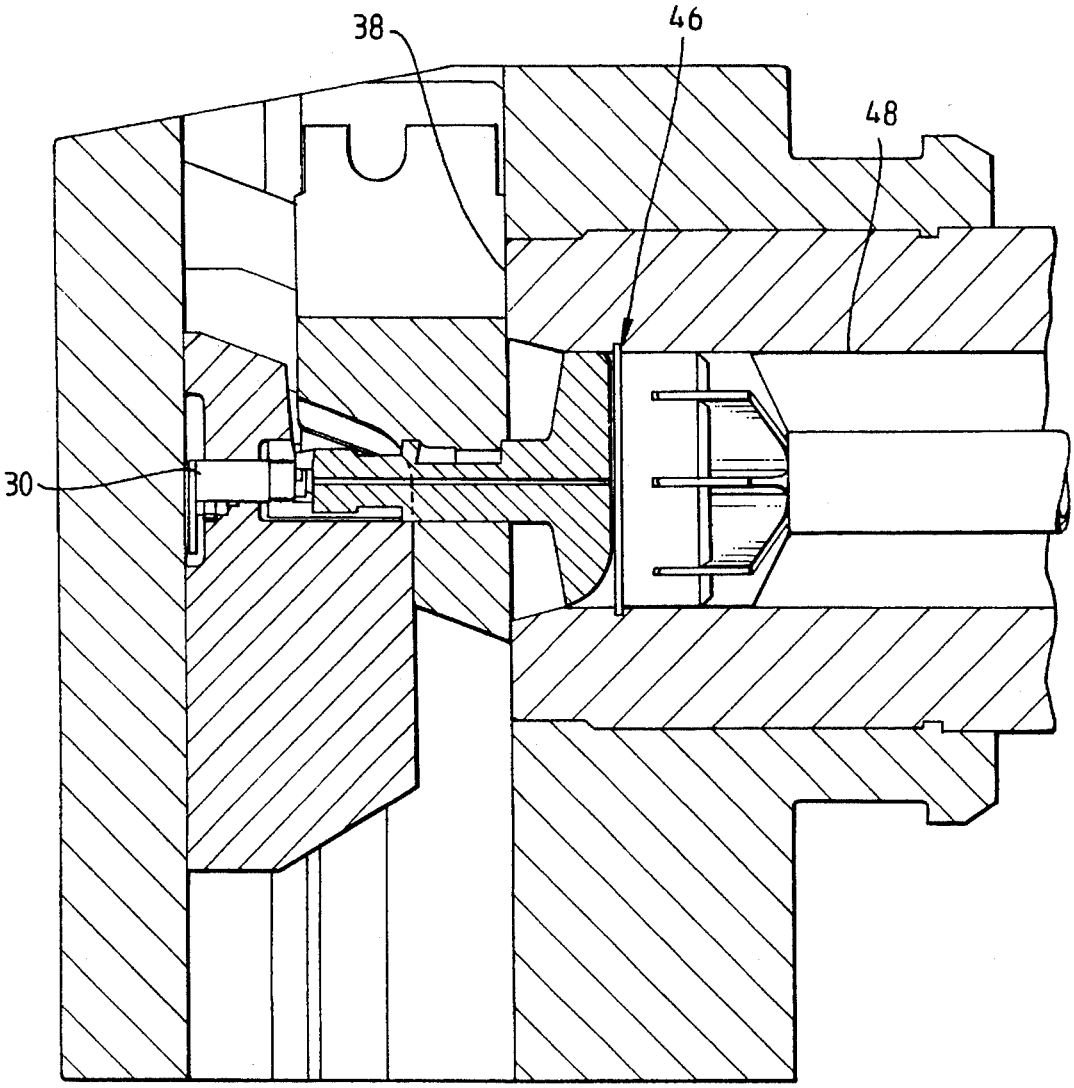
FIG. 7 shows a section through the breech assembly of a tank or artillery gun.

FIG. 7 shows the breech of a rapid fire tank or artillery gun having a split-block breech. The recess 46 is in the form of a circumferential groove in the inner wall of the barrel.

Figure 8:
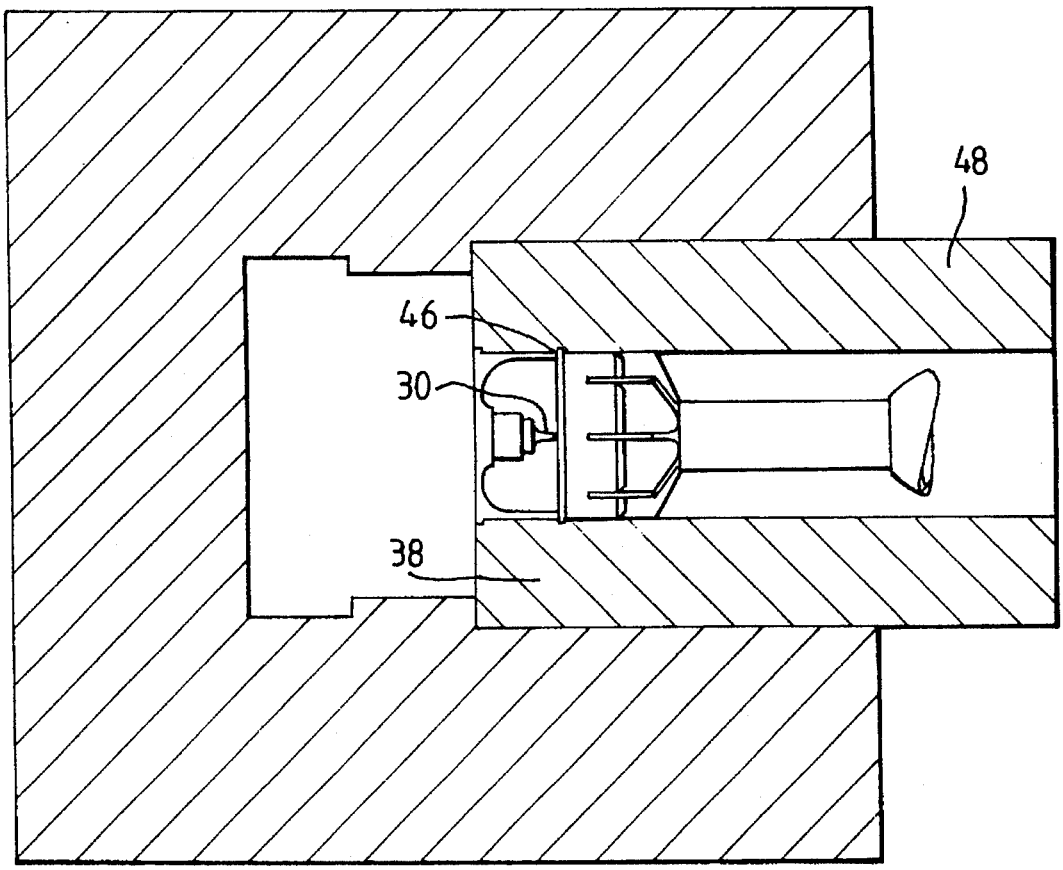
FIG. 8 shows a section through the breech assembly and part of the barrel of a gun adapted to fire cased ammunition.

FIG. 8 illustrates a stub case of a round of ammunition located in a gum barrel and adapted to fire a round of ammunition fitted with the bomb retaining clip the subject of the present invention. The inside surface of the stub case has a circumferential groove or recess 46, into which fits the flange portion 34 of the bomb retaining clip. In operation and after firing, the bomb retaining clip will be retained within the stub case and will be ejected with stub case.

We claim:

1. A clip for the retention of a round of ammunition in a desired position in a breech loading gun, barrel, whereby the clip is retained in the barrel during firing of the round, said round of ammunition having tail fins, the clip being manufactured from a plastics material and comprising:

a generally cylindrical body portion;

the body portion having a plurality of generally radially and axially directed grooves therein, said grooves engaging said tail fins by an interference fit;

engagement means, extending at least a part of the way around said body portion and having a greater diameter than that of said body portion, for engaging with a recess at a breech-end of said gun barrel to prevent forward movement of said clip and said round of ammunition; and a substantially central aperture to allow access to the propellant charge of the associated round of ammunition.

2. A retention clip according to claim 1 wherein said engagement means is selected from the group comprising: a continuous flange portion around the circumference of the body portion; a discontinuous flange portion around the circumference; and, projections around the circumference.

3. A retention clip according to claim 2 wherein the flange portion is located substantially at one axial end of the body portion.

4. A retention clip according to claim 1 wherein the clip is provided with generally axially directed holes to facilitate placement and removal.

5. A retention clip according to claim 1 wherein segments formed between adjacent grooves are resiliently movable relative to each other.

6. A retention clip according to claim 1 comprising a moulded plastics material.

7. A retention clip according to claim 6 wherein said plastics material is an acetal co-polymer.

8. A retention clip according to claim 1 and having additional grooves over and above a number required to engage said tail fins of said round of ammunition.

9. A retention clip according to claim 1 wherein said body portion has at least one aperture therein.

10. A clip for the retention of a round of ammunition in a desired position in a breech loading barrel, whereby the clip is retained in the barrel during firing of the round, the clip being manufactured from a plastics material and comprising a generally cylindrical body portion; the body portion having a plurality of grooves which extend both radially and axially with respect to said body portion; walls of said grooves resiliently engaging tail fins of said round of ammunition with an interference fit; said body portion further including engagement means extending circumferentially at least a part of the way around said body portion, said engagement means having a greater diameter than that of said body portion; said engagement means engaging with a circumferential recess at a breech-end of an associated gun barrel to prevent forward movement of said clip and the round of ammunition; and said body portion having a substantially central aperture extending through a thickness thereof to allow access to a propellant charge of the round of ammunition for ignition thereof.

11. A retention clip according to claim 10, wherein said engagement means is selected from the group comprising:

a continuous flange portion around the circumference of the body portion;

a discontinuous flange portion around the circumference; and projections around the circumference.

12. A retention clip according to claim 10, wherein the engagement means are located substantially at one axial end of the body portion.

13. A retention clip according to claim 10 wherein the clip is provided with generally axially directed holes to facilitate placement and removal.

14. A retention clip according to claim 10 wherein material is an acetal co-polymer.

15. A retention clip according to claim 10 and having additional grooves over and above a number required to engage said tail fins of said round of ammunition.

16. A retention clip according to claim 10 wherein each of said grooves has a base, at least one base has at least one aperture therein.

* * * * *